US005832702A

United States Patent [19]

Jacobson et al.

[11] Patent Number: 5,832,702

[45] Date of Patent: Nov. 10, 1998

[54] MOTION CONTROL PROFILE TO IMPROVE RELIABILITY OF INSERTER DURING INSERTION

[75] Inventors: Gary Jacobson, Norwalk, Conn.; Michael D. Ballard, Lecanto, Fla.

[73] Assignee: Pitney Bowes Inc., Stamford, Conn.

[21] Appl. No.: 939,326

[22] Filed: Sep. 29, 1997

[51] Int. Cl.[6] ..... B65B 43/26; B65B 43/28

[52] U.S. Cl. ..... 53/569; 53/284.3; 53/381.5

[58] Field of Search ..... 53/381.5, 569, 53/64, 67, 55, 52, 460, 206, 284.3; 209/597, 598, 900, 7

[56] References Cited

U.S. PATENT DOCUMENTS

| | | | |
|---|---|---|---|
| 1,754,831 | 4/1930 | Marsh . | |
| 3,193,983 | 7/1965 | Wells | 53/117 |
| 3,747,297 | 7/1973 | Hankins | 53/381 R |
| 4,846,455 | 7/1989 | Hurst | 271/2 |
| 4,852,334 | 8/1989 | Auerbach | 53/569 |
| 5,255,498 | 10/1993 | Hotchkiss et al. | 53/569 |
| 5,517,797 | 5/1996 | Ballard et al. | 53/569 |
| 5,630,312 | 5/1997 | Ballard et al. | 53/284.3 |
| 5,642,598 | 7/1997 | Cannaverde | 53/284.3 |
| 5,660,030 | 8/1997 | Auerbach et al. | 53/284.3 |

*Primary Examiner*—James F. Coan
*Assistant Examiner*—Gene L. Kim
*Attorney, Agent, or Firm*—Ronald Reichman; Melvin J. Scolnick; Martin Wittstein

[57] ABSTRACT

An envelope inserting machine has a feed path for envelopes which includes an envelope inserting position and means for feeding successive envelopes to that position. Envelope throat opening claw assemblies have claws that maintain the throat of an envelope at the inserting position open to receive a collation of insert material from a collation feeding mechanism adjacent the envelope inserting position. A microprocessor control means actuates the throat opening claw assemblies to release the upper edge of the envelope and substantially simultaneously actuates the envelope feeding means to move the envelope in a rearward direction momentarily, either after the collation is substantially fully inserted into the envelope or while it is still being inserted, to ensure that the collation is inserted sufficiently to bring the trailing edge of the collation beyond the crease line between the front panel of the envelope and the flap.

10 Claims, 8 Drawing Sheets

44
40
16
126
138
32
34
42
36
52
48
50
140
128
46
56
60
62
54
92
124
148
72
122
76
64
80
70
78
82

MOTION CONTROL PROFILE TO IMPROVE RELIABILITY OF INSERTER DURING INSERTION

CROSS REFERENCE TO OTHER APPLICATIONS

The present invention is an improvement on the invention entitled Envelope Positioning Apparatus For Inserting Machine, disclosed and claimed U.S. Pat. No. 5,517,797, issued May 21, 1996, and assigned to the assignee of this application.

BACKGROUND OF THE INVENTION

The present invention relates generally to the field of envelope inserting machines, and more particularly to an envelope inserting machine in which collations of insert material are inserted into a plurality of envelopes successively fed to an inserting position within the inserting machine.

Envelope inserting machine of the type disclosed and claimed in the above referenced patent have long been well known, and have achieved a considerable degree of commercial success in various types of high volume mailing applications, such as banks, insurance companies, utilities, and numerous other situations in which the mailer must send collations of mixed mail pieces to a large number of customers on a regular basis, such as monthly. In typical installations, the envelope inserting machine is but one component of a much larger, multi-task document handling apparatus consisting of a number of document handling components which cooperate to produce an end product mail piece. Such installation might include, for example, a computer for generating and printing customer invoices in continuous succession on a web of pre-printed or laser generated invoice forms, a web slitter and cutting machine a collating machine having a plurality of feeders for adding various types of insert material to the invoices as the latter are fed along a conveying mechanism to form collations to be inserted in envelopes, a folding machine for folding material which otherwise will not fit into an envelope, a mailing machine for closing, sealing and printing postage indicia on the envelopes, and a stacking machine for appropriately stacking the filled envelopes for mailing or other handling.

It is apparent that an apparatus as just described is very large, complex in construction and costly to purchase and operate, and therefore can only be commercially justified if it is maintained in continuous operation through the full extent of any given mailing job. If any one of the components ceases to operate for any reason, suitable sensing devices trigger a master controller to shut down the entire apparatus until the problem with the particular component can be ascertained and corrected, during which time the apparatus is idle.

In envelope inserting machines heretofore known, one source of failure of operation was that the throats of envelopes in the inserting position within the inserting machine were not being consistently opened sufficiently far to ensure that collations of insert material were being fully and properly inserted into the envelopes by the inserting mechanism, with the result that a portion of the insert material would be left protruding out of the throat of the envelope beyond the crease line between the front panel of the envelope and the flap. This condition resulted either in shutdown of the inserting machine if the protrusion of the collation was detected by appropriate sensing devices in the inserting machine, or, if the inserting machine failed to detect the improperly inserted collation, the flap of the envelope would not fold over properly in the flap closing and sealing device in the mailing machine, which would cause a jam in the mailing machine. In either event, the faulty condition would result in shutdown of the entire apparatus.

Many techniques have been devised and incorporated into prior art inserting machines for dealing with the foregoing problem of the throats of envelopes occasionally not being opened properly, and by and large these techniques have worked quite well. However, there is one situation in which a collation of insert material is not fully inserted into an envelope despite the fact that the throat is fully opened and there is no other defect feature of the envelope that would prevent proper insertion of the collation. This occurs typically where the feeding mechanism that moves the collation into the envelope is a pair of cooperating high speed feed rollers, belts, or one of each, which is disposed closely adjacent to the throat of the envelope, and which grips and feeds the collation into the envelope until the trailing edge of the collations leaves the nip of the rollers, belts, or combination thereof. Due to the nature of the roller, belt or combination structural arrangement, the end of the feeding mechanism cannot be inserted into the envelope, as can slower operating pusher type feeding devices, but must remain outside of the envelope, adjacent to the throat. Thus, the only characteristic of the feeding operation that can ensure that the collation is fully inserted into the envelope is if there is sufficient inertia in the collation to move the collation sufficiently far into the envelope after the trailing edge thereof is released by the feeding device that the trailing edge is beyond the crease line. With most collations, especially those consisting of several items, there is no problem with imparting sufficient inertia to the collation to ensure that it is fully inserted. However, this is not always so with collations consisting of very light material, or if the actual insert is not a collation, but merely a single sheet of paper, whether folded or not.

Thus, there is a need for an envelope inserting machine which incorporates a technique for ensuring that collations of insert material are moved sufficiently far into the envelopes that the trailing edges thereof are sufficiently beyond the crease lines between the flaps and the front panels of the envelopes that the flaps will fold over and seal properly when the envelopes are fed through the flap closing and sealing mechanism of the mailing machine.

BRIEF SUMMARY OF THE INVENTION

The present invention substantially alleviates if not entirely eliminates the foregoing problems associated with prior envelope inserting machines by providing a machine in which an envelope disposed at an inserting position is given a momentary, relatively short, reverse movement, either after a collation has been substantially fully inserted into the envelope and has been disengaged by the collation feeding means, or at some point while the collation is still engaged with the collation feeding means and is still being inserted into the envelope, thereby ensuring that the collation is inserted into the envelope sufficiently far to ensure that the trailing edge thereof is at or below the crease line between the front panel of the envelope and the flap.

In this environment, the present invention is embodied in an envelope inserting machine for inserting collations of insert material into envelopes successively disposed at an envelope inserting position, the inserting machine comprising means defining a path of travel for envelopes from a storage position to a predetermined inserting position along the path of travel at which collations of insert material are inserted into the envelopes, means for feeding successive envelopes in a first direction along the path of travel, claw means disposed in the path of travel adjacent the inserting position and movable between a first position in which the claw means engages opposite ends of the upper free edge of an envelope disposed in the inserting position for opening the throat of the envelope and a second position in which the claw means is disengaged from the upper edge of the envelope to permit the envelope to be moved in the reverse direction , and means disposed adjacent the inserting position for feeding successive collations of insert material into the envelopes as the envelopes are fed successively to the inserting position. The inserting machine further includes a microprocessor control means for causing the envelope feeding means to momentarily move an envelope disposed in the inserting position in the opposite direction from the first direction for a relatively short predetermined distance and at a predetermined instant relative to the movement of the collation of insert material into the envelope by the collation feeding means, whereby the reverse movement of the envelope ensures that the collation of insert material is inserted into the envelope sufficiently far that the trailing edge of the collation is at or below the crease line between the front panel of the envelope and the flap.

In some of its more limited aspects, in one embodiment of the invention, the microprocessor control means causes the envelope feeding means to move the envelope in the reverse direction after the collation of insert material has been substantially fully inserted the said envelope and has been disengaged by the inserting mechanism. A sensing means senses when the trailing edge of the collation of insert material arrives at the output end of the collation feeding means and is disengaged from the collation feeding means, and the microprocessor control means includes means responsive to operation of the sensing means for stopping the operation of the collation feeding means. The microprocessor also includes means responsive to operation of the sensing means for moving the claw means to a position intermediate the first and second positions for partially disengaging the claw means from the upper edge of the rear panel of the envelope disposed in the inserting position to permit limited reverse movement of the envelope. The microprocessor control means also maintains the collation feeding means inoperable during the reverse operation of the envelope feeding means and the reverse movement of the envelope so that the stationary collation feeding means functions as an abutment for the trailing edge of any collation not inserted sufficiently far into the envelope so that the trailing edge is at or below the crease line to prevent reverse movement of the collations during the reverse movement of the envelopes.

In another embodiment of the invention, the microprocessor control means causes the envelope feeding mechanism to move the envelope in the reverse direction while the collation is still being inserted into the envelope. A sensing means is provided to sense when the leading edge of the collation passes the upper edge of the rear panel of the envelope to ensure that the collation has properly entered the throat of the envelope, after which the envelope feeding means is operated momentarily in a reverse direction to move the envelope disposed at the inserting position in a reverse direction for the relatively short distance. Again, the microprocessor control means includes means responsive to operation of the sensing means for moving the claw means to a position intermediate the first and second positions for partially disengaging the claw means from the throat of the envelope to permit limited reverse movement of the envelope. In this embodiment of the invention, the continued operation of the collation feeding means prevents any reverse movement of the collation during reverse movement of the envelope.

Having briefly described the general nature of the present invention, it is a principal object thereof to provide an envelope inserting machine having features of construction which ensure that collations of insert material are fully and properly inserted into envelopes sufficiently far that the trailing edges of the collations are at or below the crease line between the front panels of the envelopes and the flaps.

Another object of the present invention is to provide an envelope inserting machine in which envelopes disposed at an inserting position for receiving collations of insert material are moved in a reverse direction relative to the direction of movement of the collations either after or during insertion of the insert material into the envelopes to ensure that the collations are fully inserted into the envelopes.

Still another object of the present invention is to provide an envelope inserting machine in which the envelopes are moved in the reverse direction after the collations of insert material have been inserted into the envelopes by the collation inserting mechanism, which then functions as an abutment to prevent reverse movement of any collations not already fully inserted into the envelopes by the inertia in the collations during reverse movement of the envelopes.

A further object of the present invention is to provide an envelope inserting machine in which the envelope is moved in the reverse direction while the collation of insert material is still being inserted into the envelope by the collation inserting mechanism, the continued operation of the collation inserting mechanism preventing reverse movement of the collation during reverse movement of the envelope.

These and other objects and advantageous features of the present invention will become more apparent from an understanding of the following detailed description of presently preferred modes of carrying out the principles of the invention, when considered in conjunction with the accompanying drawings.

DETAILED DESCRIPTION OF THE INVENTION

Figure 1:
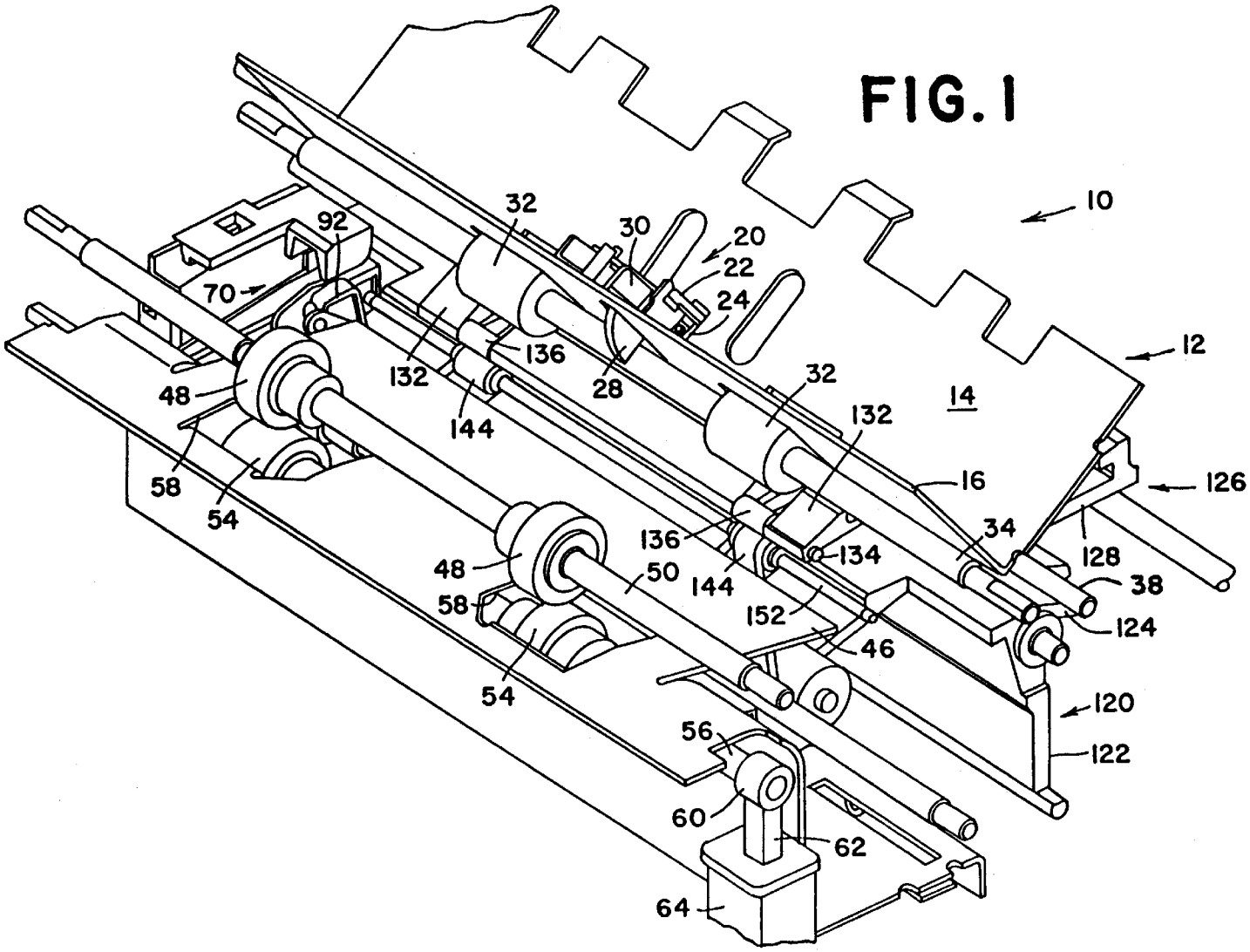
FIG. 1 is a perspective view of the major operating components of the inserting machine of the present invention.
Figure 6:
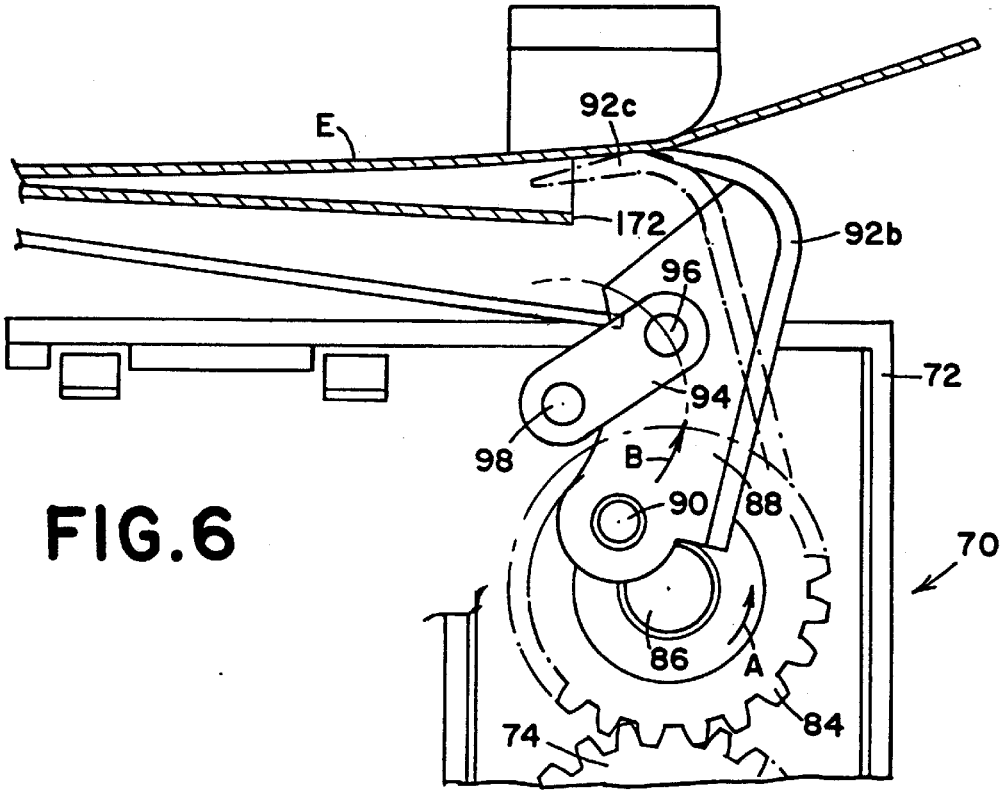
FIG. 6 is a view similar to FIG. 5, but showing the Claw assembly engaged in the throat of an envelope and about to open the throat.

Referring now to the drawings, and particularly to FIGS. 1 and 6 thereof, the envelope inserting machine of the present invention is therein designated generally by the reference numeral 10. It will be understood that all of the structure hereinafter described is suitably mounted in a frame forming part of the inserting machine 10; accordingly, only so much of the structure of the inserting machine 10 as is necessary to an understanding of the present invention is included herein.

A generally V-shaped guide plate, designated generally by the reference numeral 12, is suitably mounted on the frame, the guide plate 12 having a first slanted wall 14 which forms part of a feed path for envelopes being fed through the envelope inserting machine 10, and a second slanted wall 16 which provides suitable support for certain control elements hereinafter fully described. Another guide plate 18 (FIG. 2) is mounted beneath the wall 14 of the guide plate 12 and in spaced relationship therewith, such that the wall 14 and the wall 18 define a part of the feed path into which envelopes, such as represented by the envelope E (FIG. 2), are fed in succession. It will be understood, as is well known in the art, that the inserting machine 10 has means for feeding individual envelopes from a supply thereof, and for opening the flaps of the envelopes prior to their being fed into the inserting area of the inserting machine 10. Thus, the envelopes, again as represented by that designated E in FIG. 2, have already been fed through the initial feeding means of the inserting machine 10 and the flaps of the envelopes have been opened.

A sensing switch, designated generally by the numeral 20, is mounted on the wall 16 of the guide member 12, and includes an envelope sensing lever 22 which projects downwardly through an aperture 24 in the wall 14 so as to be disposed in the path of movement of the envelope E. The sensing lever 22 is pivotally mounted, as at 26, so that an arm 28 thereof is moved upwardly toward a switch 30 which is activated to a closed position by clockwise movement of the sensing lever 22 when an envelope E moves past the lower end of the sensing lever 22. As further explained below, the function of the sensing lever 22 and the switch 30 is to initiate operation of a microprocessor control means for positioning the envelope E in a predetermined inserting position as more fully explained below, to enable a pair of claw assemblies, also more fully explained below, to open the throat of the envelope E.

Figure 3:
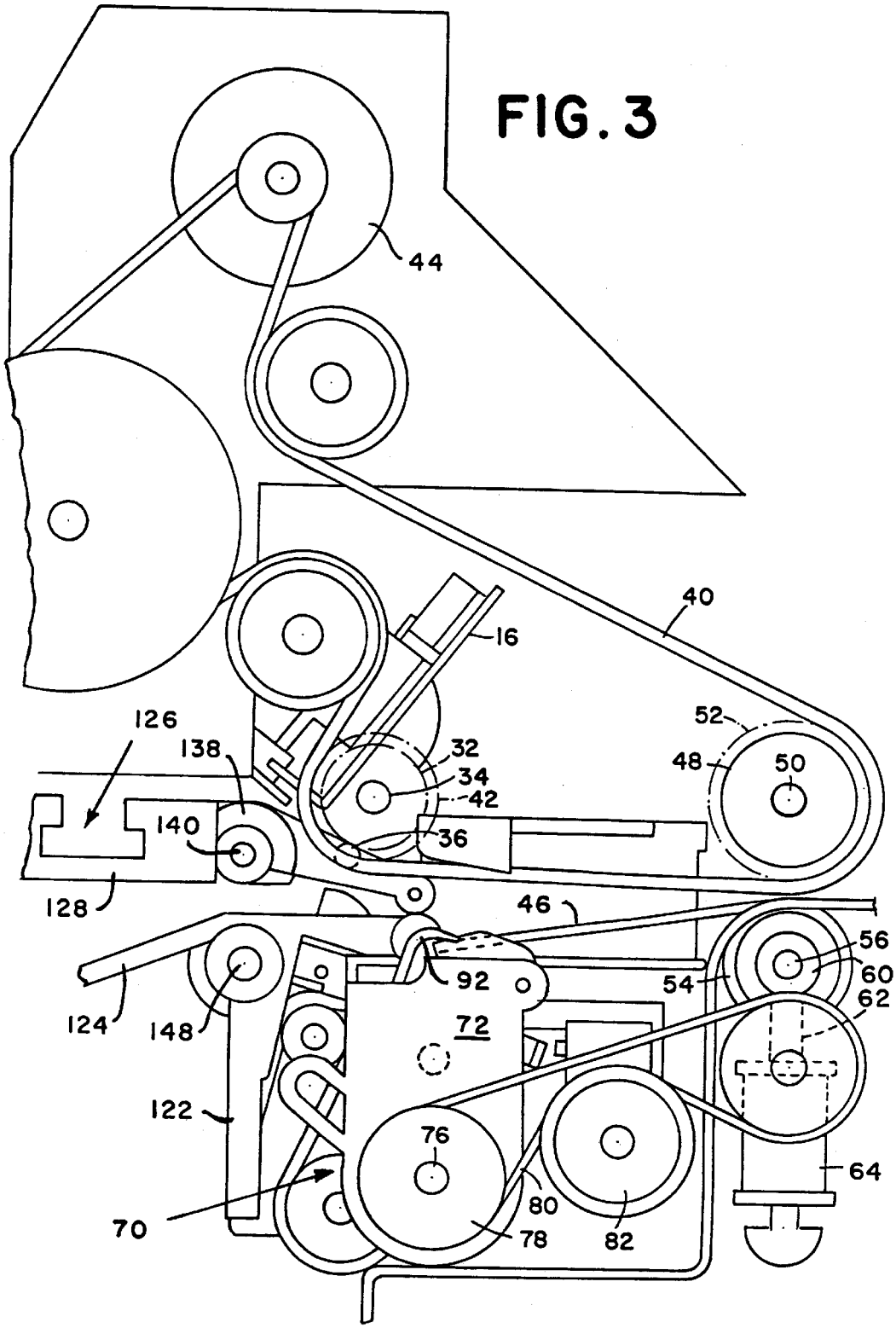
FIG. 3 is a view similar to FIG. 2 looking at the opposite side of the mechanism, and showing the drive assembly for the envelope feeding means and the Claw assembly.

A pair of feed rollers 32 are fixedly mounted on a shaft 34 for rotation therewith, and a pair of back up rollers 36 are rotatably mounted on a shaft 38 fixedly mounted in the frame. As best seen in FIG. 3, the shaft 34 is driven by a belt 40 which passes around a pulley 42 fixedly mounted on one end of the shaft 34, the belt 40 being driven by a stepper motor 44, the belt 40 also driving other components as further explained hereinbelow.

Figure 2:
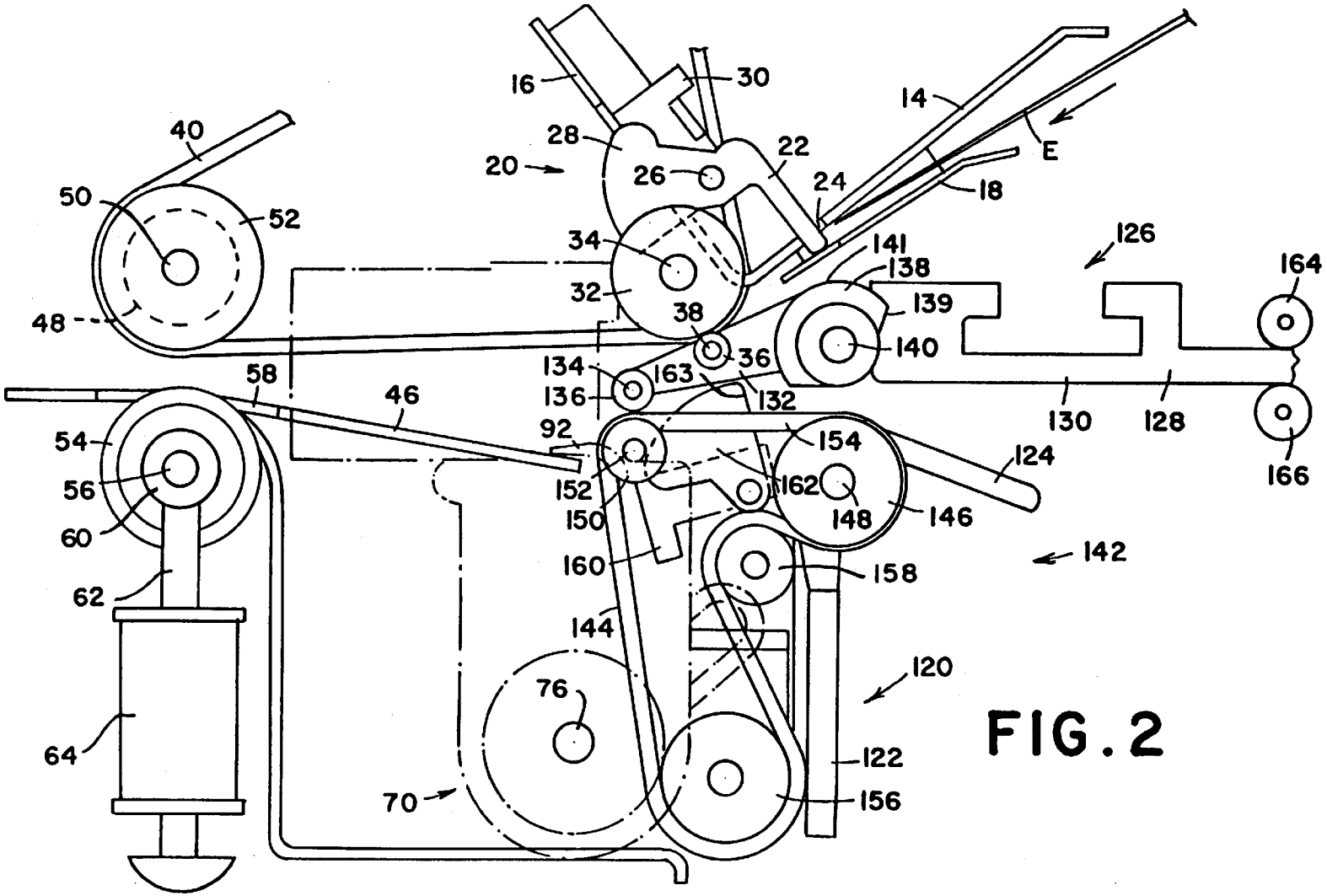
FIG. 2 is a side view of the mechanism shown in FIG. 1, showing an envelope being fed into the throat opening and positioning mechanism.
Figure 4:
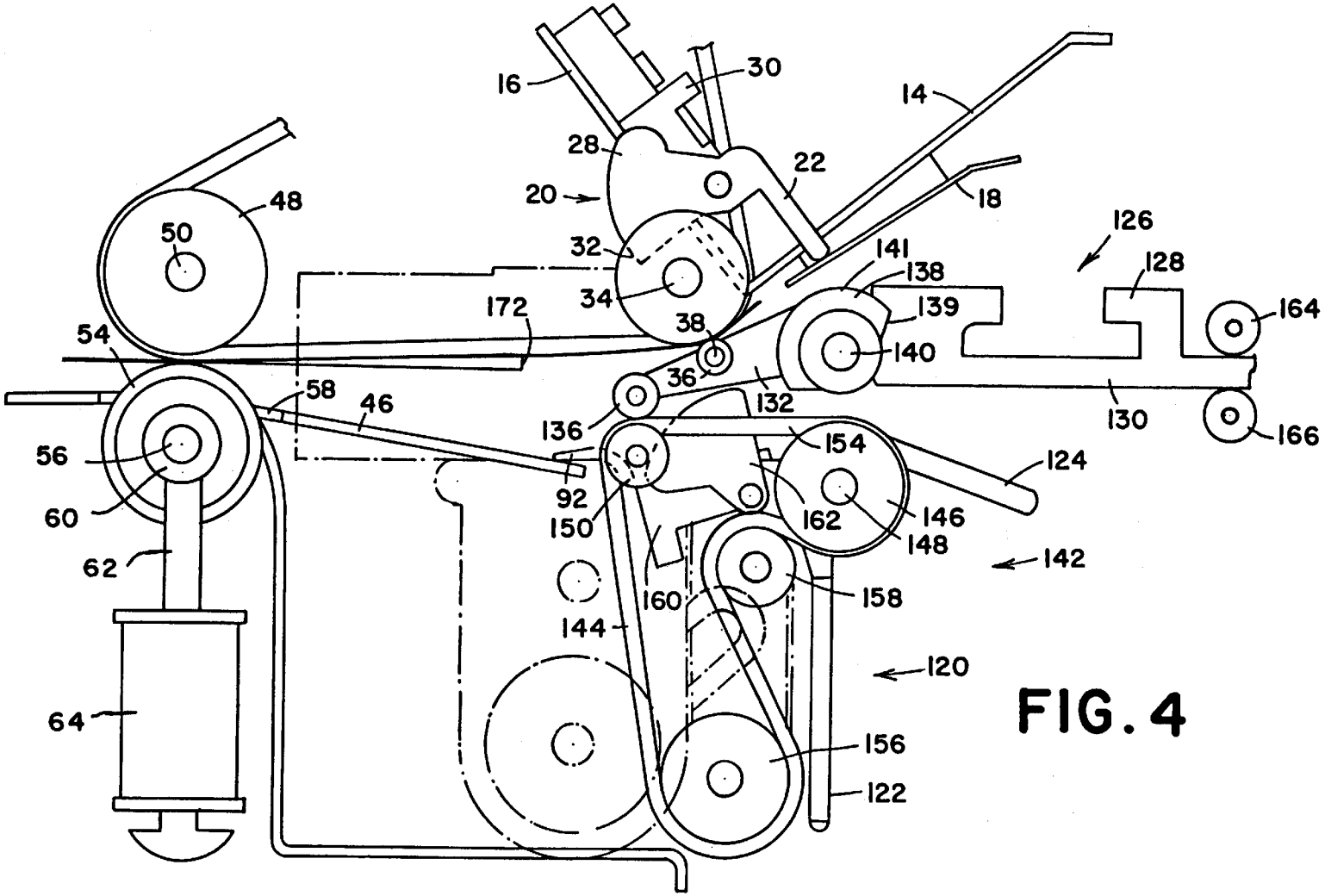
FIG. 4 is a view similar to FIG. 2, but showing an envelope in the initial predetermined position to which it is fed.

Referring now to FIGS. 1 and 2 through 4, another guide plate 46 is mounted slightly beneath and spaced in the downstream direction of an envelope E so that the lead edge of the envelope engages the guide plate 46 as the envelope is fed along the feed path defined thus far by the walls 14 and 18 and the feed rollers 32 and back up rollers 36. A pair of feed rollers 48 are fixedly mounted on a shaft 50 which is rotatably driven by the belt 40 passing around a pulley 52. A pair of back up rollers 54 are rotatably mounted on a shaft 56 mounted below the guide plate 46, and which project upwardly through apertures 58 in the guide plate 46 to engage with the feed rollers 48 when the shaft 56 is in an upper position, as shown in FIG. 1. As best seen in FIGS. 2 and 4, the ends of the shaft 56 are mounted on the upper ends 60 of solenoid plungers 62 which extend through a pair of solenoids 64. It will be seen, by comparing FIG. 2 with FIG. 4, that when the solenoids 62 are energized, the feed lower feed rollers 54 are brought into feeding engagement with the feed rollers 48 to eject envelopes from the inserting machine 10 after receiving insert material, as fully explained hereinbelow.

Figure 7:
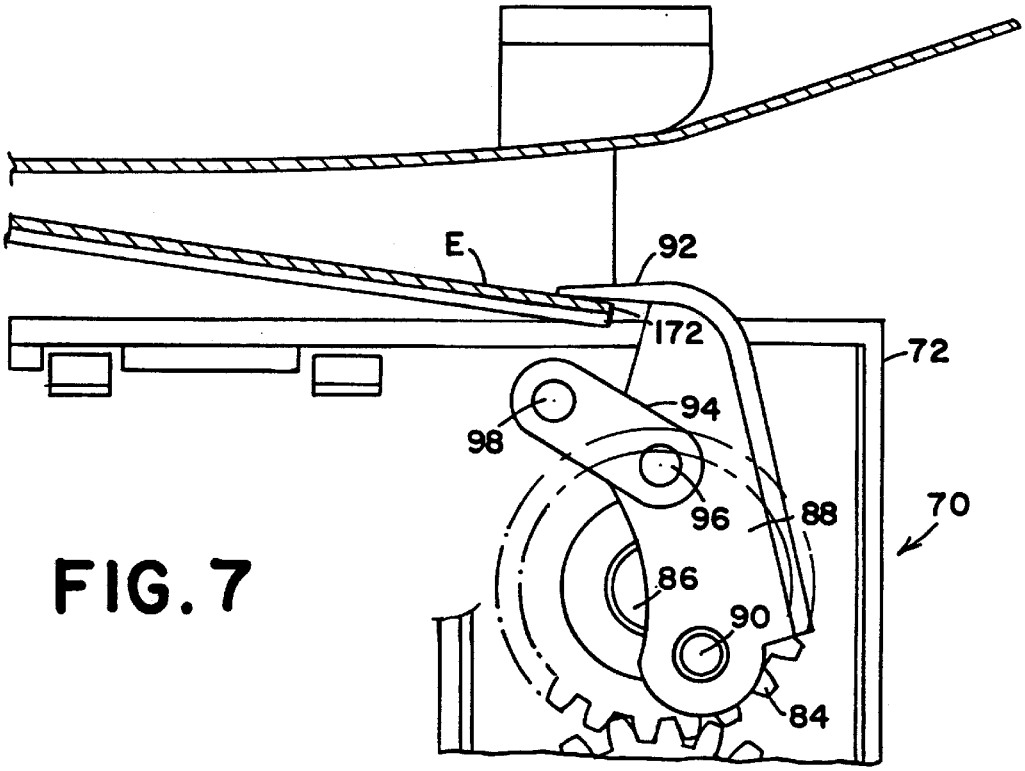
FIG. 7 is a view similar to FIG. 5, but showing the Claw assembly holding the envelope throat fully open.

Referring now to FIGS. 1, 2 and 5 through 7, it will be seen that a pair of envelope throat opening claw assemblies, designated generally by the reference numeral 70, are mounted on opposite sides of and generally beneath the plate 46 adjacent the upstream end thereof and beneath and slightly downstream of the feed rollers 32 and back up rollers 36. The claw assemblies function to engage the upper edge of the rear panel of an envelope and draw the edge downwardly while the front panel and the flap of the envelope E are maintained in an upper position, as seen in FIG. 7, thereby opening the throat the to permit insert material to be inserted into the envelope. The envelope Claw assembles 70 each include a housing 72 (FIG. 5) which encloses a driving gear 74 fixedly mounted on a shaft 76 which is journaled for rotation in the housing 72, the shaft 76 extending outside of the housing 72 on one side thereof (FIG. 3) on which is mounted a pulley 78 driven by a belt 80, which in turn is driven by a motor 82. The housing 72 also encloses a driven gear 84 which is rotatably mounted on a suitable bearing 86 such that the driven gear 84 meshes with the driving gear 74.

One end of an elongate link 88 is pivotally mounted on a pin 90 carried eccentrically by the gear 84, and the other end of the link 88 carries a claw 92 that is bent over at almost a right angle to the long dimension of the link 88. One end of a lever 94 is pivotally mounted on a pin 96 mounted on an intermediate portion of the link 88, the other end of the lever 94 being pivotally connected to another pin 98 mounted in the housing 72.

Figure 5:
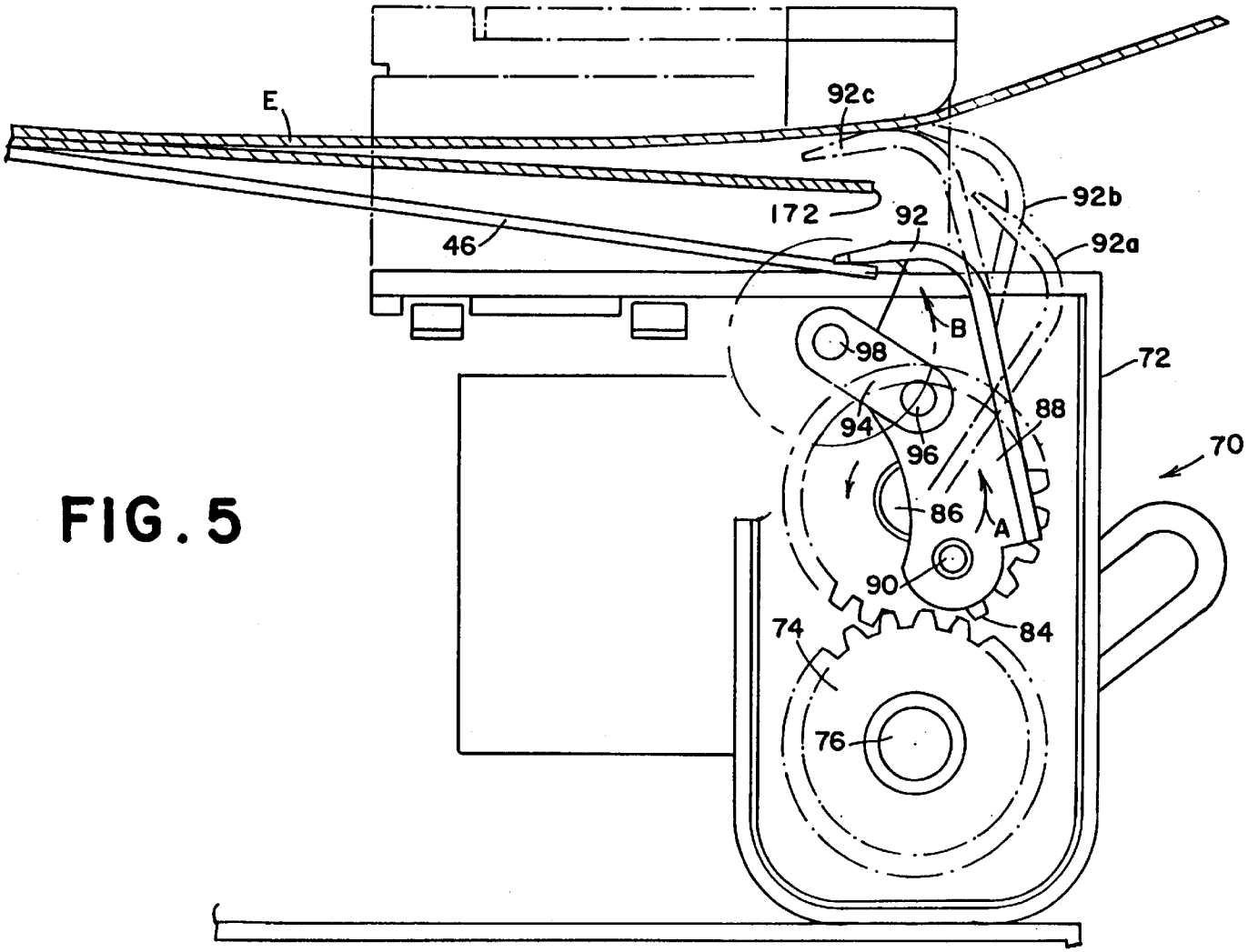
FIG. 5 is a view similar to FIG. 2, drawing to an enlarged scale, but showing the envelope in the Claw assembly attempting to open the envelope throat.

A partial description of the operation of the envelope Claw assembly will now be presented with reference to FIGS. 5 through 7. It will be seen from FIG. 5 that when the driving gear 74 is rotated in a counter clockwise direction, the driven gear 84 is rotated in a clockwise direction, and the pin 90 follows an orbital path around the shaft 86 as indicated by the arrow A. Rotation of the pin 90 causes the lower end of the link 88 to follow the same orbital path as the pin 90, but since the link 88 is connected by the pin 96 to the lever 94, which in turn is connected to the housing 72 by the pin 98, the pin 96 also follows an orbital path as indicated by the arrow B, and the link 88 is initially oscillated in a clockwise direction about the pin 90 as it moves upwardly from the position shown in FIG. 5 to cause the claw 92 to move from the solid line position to the first dotted line position indicated by the numeral 92*a*. Further rotation of the gear 84 causes the pins 90 and 96 to reach substantially uppermost positions, as shown in FIG. 6, which causes the link 94 to reach its uppermost position to bring the claw 92 to the second dotted line position 92*b* shown in FIG. 5 and the solid line position 92*b* shown in FIG. 6. Still further rotation of the gear 84 causes the link 88 to oscillate in a counter clockwise direction about the pin 90 which now causes the claw 92 to moved in a downstream direction with respect to the movement of envelopes along the feed path so that the claw 92 now reaches the dotted line position 92*c* in FIGS. 5 and 6. As will be more fully explained hereinbelow, this is the position in which the claw 92 of each claw assembly 70 engages the upper edge 172 of the rear panel of the envelope to open the throat. As the gear 84 completes one revolution and returns to the position shown in FIG. 5, the link 88 is pulled downwardly by the pin 90 so that the claw 92 is also pulled downwardly from the dotted line position 92*c* in FIGS. 5 and 6 to the solid line position 92 in FIGS. 5 and 6.

Since the specific structure by which the package of insert material is inserted into the envelope is not a part of the present invention, it is hereinafter described only to the extent that it interacts with the present invention. With reference to FIGS. 1, 2 through 4 and 8, it will be seen that a generally T-shaped member, indicated generally by the reference numeral 120, extends across the envelope positioning apparatus 10 and is suitably mounted in the frame thereof for limited vertical movement. The member 120 has a vertically extending web 122, and a generally horizontal upper cross piece 124 which forms a supporting surface for the forward portion of the insert material as hereinafter more fully explained. Another member, indicated generally by the reference numeral 126, is mounted between the envelope positioning apparatus frame, this member having an elongate rear portion 128, the under surface 130 thereof forming a guide surface for the insert material, also as hereinafter more fully explained. A pair of relatively short forwardly projecting extensions 132 support a shaft 134 on which is mounted a pair of spaced apart back up rollers 136. A plurality of D-rollers 138 having insert material engaging surfaces 139 are mounted on a shaft 140 which is suitably driven by a motor 141 (not shown except in the schematic of FIG. 9) under the control of the microprocessor as hereinafter described.

Figure 8:
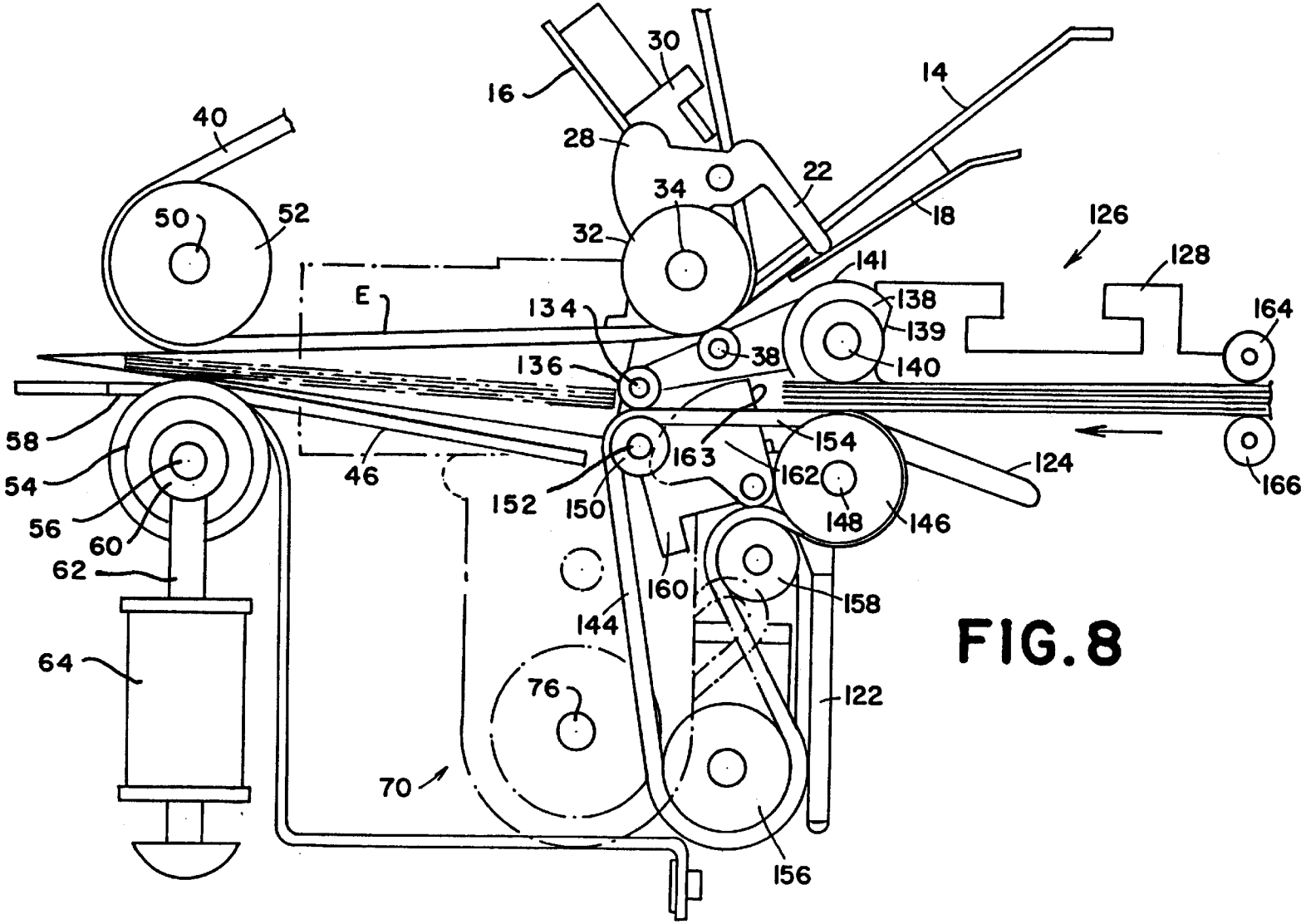
FIG. 8 is a view similar to FIG. 2 showing the envelope throat being held fully open and insert material being inserted thereinto.

The T-shaped member 120 supports a pair of feeder assemblies, indicated generally by the reference numeral 142 in FIG. 2, each feeder assembly having a feed belt 144 which passes around a drive pulley 146 mounted on a shaft 148 which is suitably connected in driving engagement with the shaft 140 for the D-rollers 138. Thus, the pulleys 146 are driven in synchronism with the D-rollers 138. The belts 144 also pass around pulleys 150 rotatably mounted on a shaft 152 suitably mounted in the feeder assemblies 142 so as to present a substantially horizontal portion 154 of the belt 144. The belt 144 also passes around a lower pulley 156 and a small adjustably mounted pulley 158 which permits tension adjustment on the belt 144. A switch 160 is suitably mounted between the feeder assemblies 142 and has a spring loaded actuator 162 pivotally mounted on the feeder assembly so as normally to have an insert abutment face 163 disposed in the path of movement of insert material to move the actuator 162 from the position shown in the figures to a position in which the actuator 162 is depressed beneath the lower surface of the insert material for a purpose to be explained below. Finally, a pair of cooperating feed rollers 164 and 166 are mounted in the inserting machine component to feed the insert material to a standby position beneath the rear portion 128 of the member 126, in which the insert material rests on any suitable support members 131 suitably mounted on the frame of the inserting machine 10, as seen in FIG. 8.

With the parts and the insert material in the positions shown in FIGS. 2 and 8, it will be seen that when, in a manner described below, an appropriate signal is sent to the drive motor 141 for the shaft 140, the D-rollers 138 are rotated in a clockwise direction to cause the material engaging surface 139 of each roller to engage the upper surface of the insert material, thereby pressing the lower surface thereof against the upper surface of the belt 144 where it passes over the pulley 146. The feeder assemblies 142 and the support members 131 are suitably mounted to move downwardly to accommodate the thickness of the insert material between the peripheral surface 141 of the D-roller and the upper surface of the belt 144, so that the insert material is fed into the nip of the roller 136 and the upper surface of the flat portion of the belt 144, which is permitted by the downward movement of the feeder assembly 142. The insert material then moves along the upper run 154 of the belt 144 and between the nip of the belt 144 and the back up rollers 136, which move the insert material into the envelope E. During this movement, the switch actuator 162 moves downwardly to actuate the switch 160 and back to its normal position after the trailing edge of the insert package passes the switch actuator 162 for a purpose further described hereinbelow.

Figure 9:
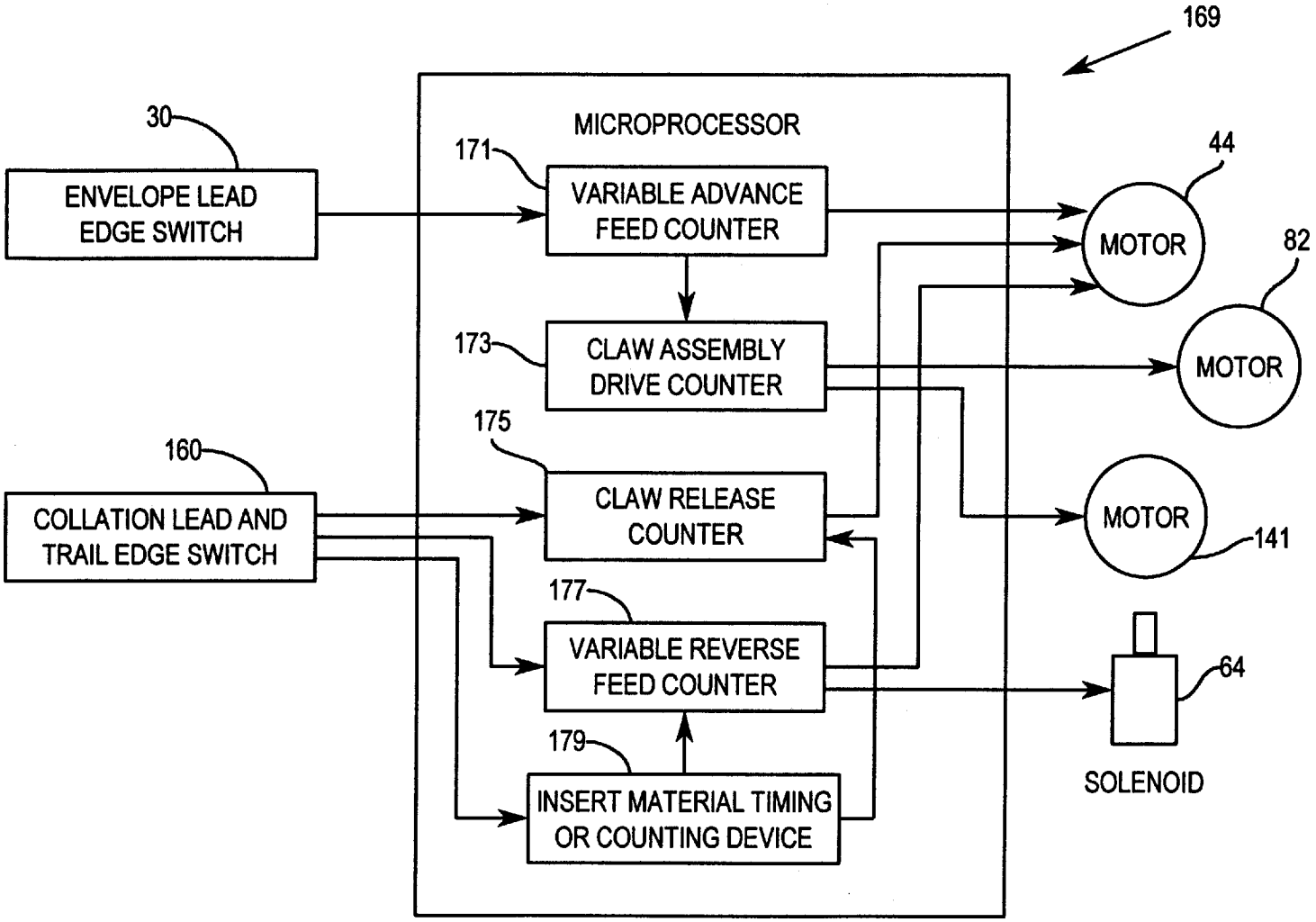
FIG. 9 is a relatively simple schematic diagram of the electrical and electronic control components of the apparatus embodying the present invention.

FIG. 9 is a relatively simple schematic diagram of the major control components of the envelope inserting machine 10, and illustrates the manner in which the above described switching and driving components interact through the microprocessor to control the movements of the envelope E to the insert position, then momentarily in the reverse direction to ensure that the insert material is properly inserted into the envelope, and finally again in the first direction to be ejected from the inserting machine 10. The control components include a microprocessor, indicated generally by the reference numeral 169, which includes a variable advance feed counter 171, a claw assembly drive counter 173, a claw release drive counter 175 and a variable reverse feed counter 177, all of which control the duration of operation of the infeed, reverse and outfeed movements of envelopes, the claw release movement and the inserting movement of the collations of insert material, respectively. FIG. 9 also shows the envelope lead edge switch 30 and the collation leading and trailing edge switch 160, as well as the drive motors 44, 82 and 141 for the envelopes, the claws and the insert material collations respectively. Also show is the solenoid for engaging the eject rollers 48 and 54.

Thus, with reference now to all of the figures, a complete cycle of operation of the envelope inserting machine 10 will now be described. When an envelope E is initially fed by any suitable upstream envelope storage and feeding mechanism into the portion of the feed path of the envelope inserting machine 10 represented by the guide plates 14 and 18, the lead edge of the envelope engages and moves the sensing lever 22 which actuates the switch 30. This causes the microprocessor 169 in an appropriate manner known in the art to energize the stepper motor 44 to cause the drive belt 40 to move the envelope E for a predetermined distance along the feed path until the envelope reaches a predetermined inserting position in which the upper edge 172 of the rear panel of the envelope is at a location adjacent the position of the claw 92 when it is in the home position shown in FIG. 2 and the envelope throat opening position shown in FIGS. 7 and 8. The predetermined distance traveled by the envelope is represented by a count in the variable advance feed counter 171, which has been set in accordance with variations in the physical characteristics of the envelope, and when the stepper motor 44 has been driven by this number of counts, the microprocessor 169 stops further operation to arrest the movement of the envelope at the desired inserting position, which is approximately the position shown in FIG. 4.

At this point, the variable advance feed counter sends a signal to the claw assembly drive counter 173 indicating that the envelope E is in the designated inserting position, so that the claw assembly drive counter 173 actuates the stepper motor 82 to commence operation of the claw assemblies 70, and drives the stepper motor 82 for a duration sufficient to cause the claw assemblies 70 to go through one complete cycle of operation of the parts thereof, as described above, to move the claws 92 from the home position shown in FIG. 2 to the envelope throat opening position shown in FIGS. 7. When the count in the claw assembly drive counter 173 has been reached and the envelope throat is open, the claw assembly drive counter 173 appropriately energizes the motor 141 to cause rotation of the shaft 140 and the D-rollers 138 as described above, to commence movement of the collation of insert material from the position shown in FIG. 8 toward the envelope E.

When the lead edge of the collation of insert material strikes the abutment face 163 of the switch actuator 162, it is depressed beneath the lower surface of the collation and engages the switch 160, which is of the type that does nothing until the actuator 162 is disengaged from the switch 160, which occurs when the trailing edge of the collation of insert material passes the actuator 162. When this occurs, the switch 160 performs two functions, the first of which is to reenergize the claw assembly motor 82 for a brief count as controlled by the claw release counter 175 to retract the claw 92 from engagement with the upper edge 172 of the rear panel of the envelope E and move it approximately to the position 92*a* seen in FIG. 5. In addition to physically permitting movement of the claw 92 to this position to permit reverse movement of the envelope, it also has the advantage of releasing the envelope to permit it to relax into a more natural shape, as seen in FIG. 8, than it has when being stretch by the claws 92.

The second function of the switch 160 is to reenergize the envelope feed motor 44, but in the reverse direction, through the reverse feed counter 177 to cause the motor 44 to momentarily move the envelope E backwards for a short distance, to approximately the position shown in FIG. 8. In a typical situation, the pulse count in the reverse feed counter is sufficient to move the envelope in the reverse direction approximately one quarter of an inch from the position shown in FIG. 8, during which the trailing edge of the collation of insert material abuts the downstream nip of the back up rollers 136 and the feed belts 144, thereby preventing reverse movement of the collation during reverse movement of the envelope, with the result that the collation is pushed further into the envelope to ensure that the trailing edge of the collation is pushed sufficiently below the crease line between the flap and the front panel of the envelope, the flap will close and seal properly.

When the full count for the reverse movement of the envelope has been reached, the reverse feed counter 177 causes the microprocessor 169 to reenergize the motor 44 in the direction of forward movement of the envelope E, and simultaneously to energize the solenoids 62 to raise the rollers 54 so that the envelope E with the insert material therein pressed against the belts 40 in driving engagement therewith and is ejected from the inserting machine 10.

In the alternate embodiment of the invention, the structural arrangement of the envelope inserting machine 10 is substantially the same as described above and therefore requires no further description except as follows: The difference between this embodiment and that already described is that the envelope is moved rearwardly from the inserting position while the collation of insert material is still being inserted into the envelope and is still under the control of the collation feeding belt 154 and back up roller 136, rather than after the collation has been substantially fully inserted into the envelope and has been released by the belt 154 and back roller 136. A advantage of moving the envelope while the insert is still being inserted is that the claws 92 can be disengaged from the upper edge 172 of the rear panel of the envelope at an earlier point than with the previous embodiment, while allows the envelope to relax into a more natural shape than when the throat is being held open by the claws 192, and this facilitates better insertion of the collation than with the previous embodiment. The disadvantage to this method is that it requires an additional component in the control system because it become necessary with this arrangement to monitor the location of the leading edge of the collation while it is being inserted into the envelope to ensure that the claws 92 do not release the edge 192 of the envelope until the leading edge of the collation has passed the upper edge 172 and has entered the throat of the envelope.

Thus, with reference still to FIG. 9, it will be seen that the microprocessor 169 includes a suitable timing device or counting device 179 to determine when the leading edge of the collation of insert material arrives at some point within the envelope that is beyond the throat opening, as represented by the upper edge 172 of the rear panel of the envelope, after which the motor 44 can be energized in the reverse direction to move the envelope in the reverse direction for the same purpose as described above. The timing or counting device 179 is responsive to the lead edge of the collation of insert material triggering the switch 160 to start the timing or counting device 179, which then energizes the motor 82 to move the claws 92 to the standby position, and which in turn energizes the motor 44 through the reverse feed counter 177 to drive the motor 44 in the reverse direction when the time or count, as the case may be, expires or is reached. In this embodiment, there is no need to provide an abutment to prevent reverse movement of the collations of insert material during reverse movement of the envelope because the collation is still under the control of the feed belts 154 and the back up rollers 136.

It is to be understood that the present invention is not to be considered as limited to the specific embodiments described above and shown in the accompanying drawings, which are merely illustrative of the best modes presently contemplated for carrying out the invention and which is are susceptible to such changes as may be obvious to one skilled in the art, but rather that the invention is intended to cover all such variations, modifications and equivalents thereof as may be deemed to be within the scope of the claims appended hereto.

We claim:

1. An envelope inserting machine for inserting collations of insert material into envelopes successively disposed at an envelope inserting position, said inserting machine comprising:

A. means defining a path of travel for envelopes from a storage position to a predetermined inserting position along said path of travel at which collations of insert material are inserted into said envelopes, B. means for feeding successive envelopes in a first direction along said path of travel, C. claw means disposed in said path of travel adjacent said inserting position and movable between a first position in which said claw means engages opposite ends of the upper edge of the rear panel of an envelope disposed in said inserting position for opening the throat of said envelope, and a second position in which said claw means is disengaged from said upper edge of said envelope to permit reverse movement of said envelope, D. means disposed adjacent said inserting position for feeding successive collations of insert material into said envelopes as said envelopes are fed successively to said inserting position, and E. microprocessor control means for causing said envelope feeding means to momentarily move an envelope disposed in said inserting position in the opposite direction from said first direction for a relatively short predetermined distance and at a predetermined instant relative to the movement of said collation of insert material into said envelope by said collation feeding means, whereby said reverse movement of said envelope ensures that said collation of insert material is inserted into said envelope sufficiently far that the trailing edge of the collation is at or below the crease line between the front panel of said envelope and the flap.

2. An envelope inserting machine as set forth in claim 1 wherein said microprocessor control means includes means for causing said envelope feeding means to move said envelope in said reverse direction after said collation of insert material has been substantially fully inserted into said envelope and has been disengaged by said inserting means.

3. An envelope inserting machine as set forth in claim 2 wherein

A. said collation feeding means includes sensing means for sensing when the trailing edge of said collation of insert material arrives at the output end of said collation feeding means and is disengaged from said collation feeding means, and B. said microprocessor control means includes means responsive to operation of said sensing means for stopping the operation of said collation feeding means.

4. An envelope inserting machine as set forth in claim 3 wherein said microprocessor control means further includes means responsive to operation of said sensing means for moving said claw means to a position intermediate said first and second positions for partially disengaging said claw means from said upper edge of said rear panel of said envelope disposed in said inserting position to permit limited reverse movement of said envelope.

5. An envelope inserting machine as set forth in claim 4 wherein said microprocessor control means further includes means responsive to said sensing means for causing said envelope feeding means to operate momentarily in a reverse direction to move said envelope disposed at said inserting position in a reverse direction for said relatively short distance.

6. An envelope inserting machine as set forth in claim 5 wherein said microprocessor control means maintains said collation feeding means inoperable during said reverse operation of said envelope feeding means and said reverse movement of said envelope, so that said stationary collation feeding means functions as an abutment for the trailing edge of any collation not inserted sufficiently far into said envelope so that said trailing edge is at or below said crease line to prevent reverse movement of said collation during said reverse movement of said envelope.

7. An envelope inserting machine as set forth in claim 1 wherein said microprocessor control means includes means for causing said envelope feeding means to move said envelope in said reverse direction while said collation of insert material remains engaged with said collation feeding means and is being inserted into said envelope.

8. An envelope inserting machine as set forth in claim 7 wherein

A. said collation feeding means includes sensing means for sensing when a collation of insert material has been inserted into an envelope disposed at said inserting position sufficiently far that the leading edge of said collation has passed said upper edge of said rear panel of said envelope, and B. said microprocessor control means includes means responsive to operation of said sensing means for causing said envelope feeding means to operate momentarily in a reverse direction to move said envelope disposed at said inserting position in a reverse direction for said relatively short distance.

9. An envelope inserting machine as set forth in claim 8 wherein said microprocessor control means further includes means responsive to operation of said sensing means for moving said claw means to a position intermediate said first and second positions for partially disengaging said claw means from said upper edge of said rear panel of said envelope disposed in said inserting position to permit limited reverse movement of said envelope.

10. An envelope inserting machine as set forth in claim 9 wherein said microprocessor control means maintains said collation feeding means operable during said reverse operation of said envelope feeding means and said reverse movement of said envelopes to prevent reverse movement of said collation during said reverse movement of said envelope.

* * * * *